US005760376A

United States Patent [19]

Schuyler

[11] Patent Number: 5,760,376

[45] Date of Patent: Jun. 2, 1998

[54] AIR HEATER WITH SELF-SUPPORTING HEATER ELEMENT

[75] Inventor: Martin Schuyler, Hastings-on-Hudson, N.Y.

[73] Assignee: Cox 3 Company, Inc., New York, N.Y.

[21] Appl. No.: 665,915

[22] Filed: Jun. 19, 1996

[51] Int. Cl.[6] ..... H05B 3/40

[52] U.S. Cl. ..... 219/534; 219/549

[58] Field of Search ..... 219/520, 530, 219/531, 532, 534, 535, 539, 543, 548, 549

*Primary Examiner*—Tu B. Hoang

[57] ABSTRACT

A unitary self-supporting heater element is sinuous and has at least one generally U-shaped section. The heater element is contained within a hollow open ended case. The resulting heater is suitable for explosion-proof applications, small, lightweight and inexpensive to manufacture.

8 Claims, 5 Drawing Sheets

AIR HEATER WITH SELF-SUPPORTING HEATER ELEMENT

BACKGROUND OF THE INVENTION

The invention relates to air heaters, and more particularly relates to electro-thermal air heaters. In its most immediate sense, the invention relates to electro-thermal air heaters of the explosion-proof type.

Air heaters used in aircraft must be explosion-proof, i.e. must not expose the air to temperatures exceeding 390° F. This is because higher temperatures pose the risk of igniting any fuel vapors that might be present. Conventionally, a safety margin is provided, so that a typical aircraft air heater might only expose the air to a maximum temperature of perhaps 300° F.

In one conventional type of aircraft air heater, a heater element is bonded to a finned heat exchanger, and heat flows from the hotter heater to the cooler heat exchanger. Because the heat exchanger is limited to low temperature operation and must nonetheless heat the air, the heat exchanger must have a large heat transfer area. This in turn requires that the heat exchanger, and therefore the heater, be large and heavy.

In another conventional type of aircraft air heater, the thermal inefficiencies of such a finned heat exchanger are reduced by using a plurality of parallel heater plates to heat the air directly. The plates are mounted within a cylindrical casing and the air flows between them.

In this type of aircraft air heater, the heater plates are electrically wired together and are separately mounted within the casing. This type of construction is costly, and the end product is insufficiently reliable because the connections between heater plates are subject to failure.

It would be advantageous to provide an explosion-proof electro-thermal air heater that would, as compared with existing designs, be smaller, lighter weight, more reliable and less costly to manufacture.

In accordance with the invention, there is provided a unitary, self-supporting, and electrically conductive heater element. The element produces heat as a result of electrical current flowing through it. The element is sinuous; it has one, and advantageously more, generally U-shaped sections. A hollow open-ended case surrounds the element.

Because the heater element is unitary, electrical interconnections are unnecessary. This reduces cost and increases reliability. Because the heater element has at least one and advantageously a plurality of generally U-shaped sections, the large surfaces where heat is transferred to the air are parallel planes. This produces a low pressure drop from one end of the heater to the other.

Advantageously, and in one preferred embodiment, the heater element is held within the case by pressure exerted by the heater element against the case. Further advantageously, the heater element is of stainless steel, and the element is formed by bending a blank. These expedients make it possible to assemble the preferred embodiment inexpensively; it is only necessary to bend the heater element into the appropriate shape, to compress it so it fits within the case, and to allow the heater element to expand within the case so as to be held therein by spring pressure.

In another preferred embodiment, the heater element is adhesively secured inside the case. This alternative construction is useful when the finished heater is intended for service in high-shock and/or high-vibration applications.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 1:
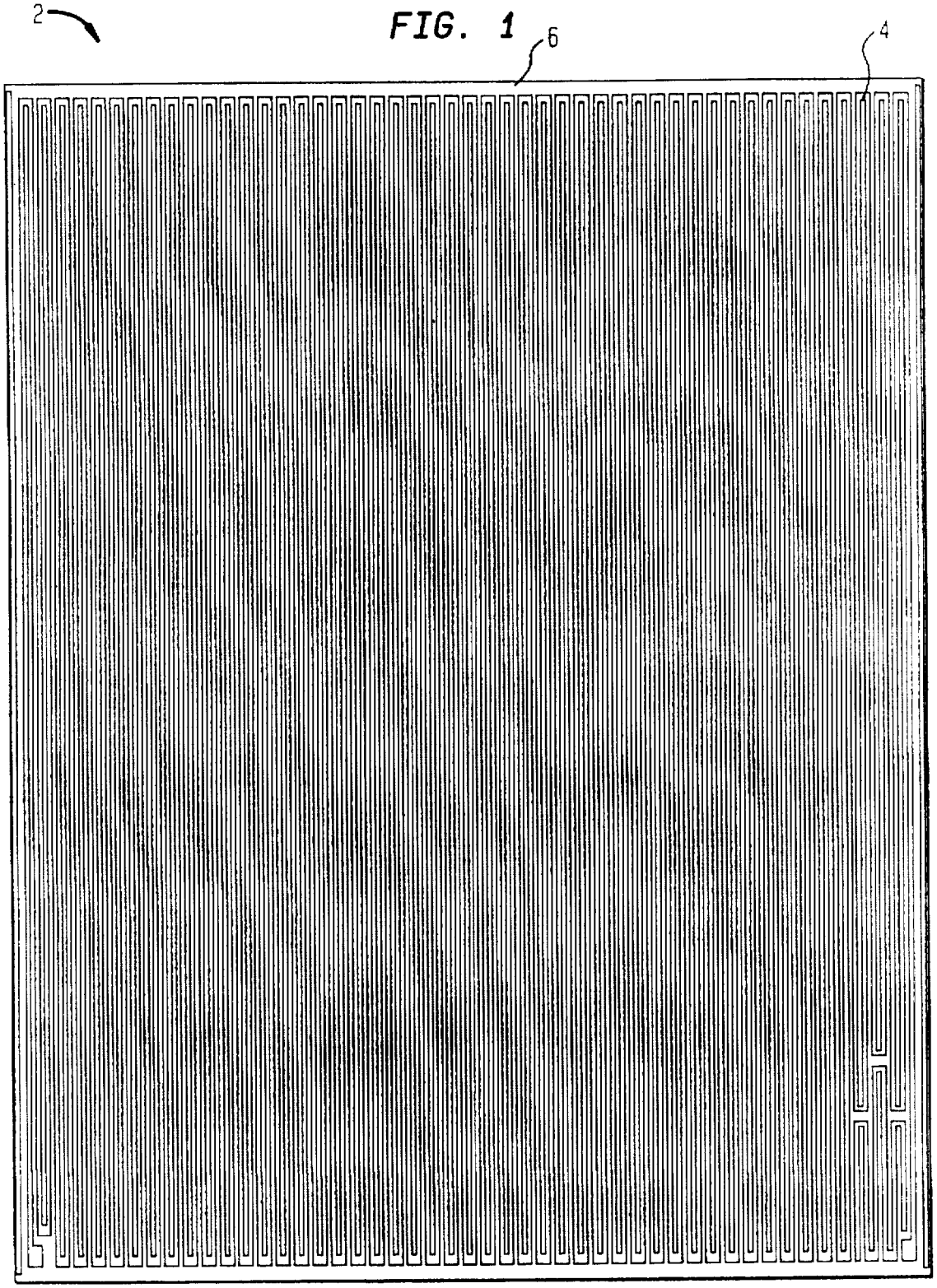
FIG. 1 is a top view of a heater element blank in accordance with a preferred embodiment of the invention.

A heater element blank such as is illustrated in FIG. 1 and generally indicated by reference numeral 2 has a unitary and electrically conductive self-supporting heater element 4. Advantageously, the heater element 4 is made of etched stainless steel sheet stock. (Stainless steel is preferred because it is inexpensive, readily available in a variety of thicknesses, easy to etch, corrosion resistant, and because it can withstand high temperatures. However, stainless steel is not necessary. The heater element 4 may be of any material that is both electrically conductive and rigid enough to provide a self-supporting heater element.) In this example, the heater element 4 is made of 0.010" thick stainless steel, but this is not part of the invention; the thickness is determined by the application desired.

The heater element 4 is sandwiched between two layers 6 of electrical insulation material. Advantageously, the layers 6 are of polyimide; KAPTON® is presently preferred, but any other insulator may be used instead. To secure the polyimide layers 6 to the heater element 4, a high temperature thermoplastic adhesive (e.g. FEP, or fluorinated ethylene-propylene) is used, but this is not required and another type of adhesive may be used if the insulation is of a different material.

Advantageously, to form the blank 2, one layer 6 of KAPTON® is initially adhered to the heater element 4. The heater element 4 is then etched to the desired pattern. Then, the other layer 6 of KAPTON® is adhered to the other side of the heater element 4. Although this methodology is not required, it is preferred; it makes the resulting blank 2 easier to handle .

Figure 2:
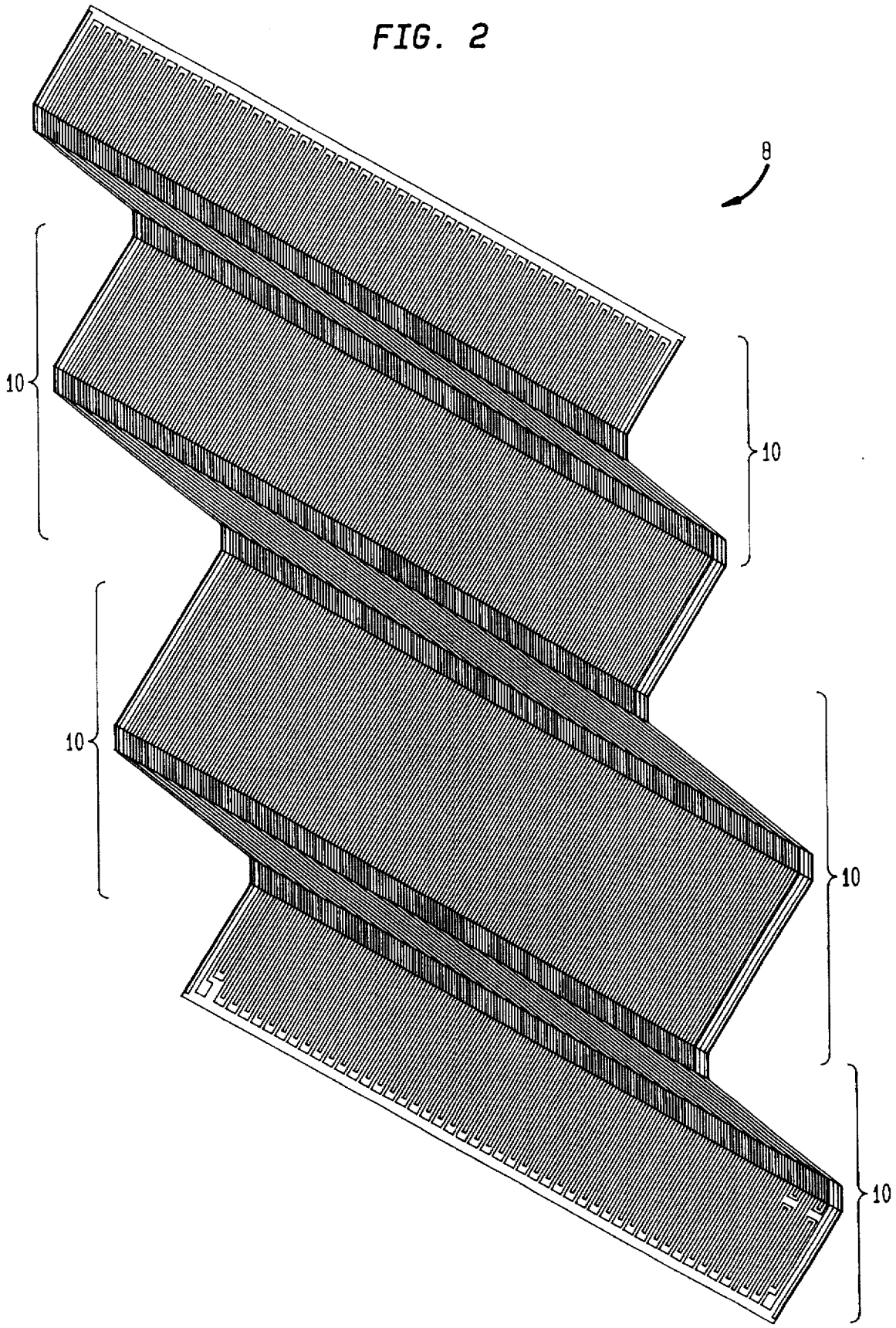
FIG. 2 shows how the FIG. 1 blank is bent into a heater element assembly for use in a preferred embodiment.

The blank 2 is then bent (in e.g. a bending brake) to form an insulated heater element assembly 8 (see FIG. 2). The heater element assembly 8 has a sinuous shape that has at least one, and advantageously more, generally U-shaped sections 10. FIG. 2 has been exaggerated for clarity. As shown, the sections 10 are widespread; in practice, the sections 10 would be much closer to a series of Us. The sections 10 are dimensioned so that when the air heater is finally assembled, they will be at least generally, if not exactly, U-shaped. In this manner, the finished heater presents little resistance to air flowing through it and there is only a minimal pressure drop between the ends of the heater.

Once the heater element assembly 8 has been bent to the shape desired, other components (if required) may be attached to it. In the preferred embodiment, a thermostat 12 is secured and thermally connected to the heater element 4 and connected in series (as by wires 14) with the heater element 4 to prevent overheating. If for example the airflow supply is interrupted, the temperature of the heater element 4 will rise, thereby heating the thermostat 12 past its setpoint and interrupting the supply of power to the heater element 4.

In further accordance with the preferred embodiment, a second thermostat 16 is mounted to the heater element 4 adjacent the outlet end of the finished heater. The thermostat 16 responds to the temperature of the heated air and turns the power supply (not shown) to the heater element 4 on and off to maintain the air at the desired temperature. The heater element 4 is absent beneath the thermostat 16 so as not to bias its setting. The thermostats 12 and 16 are not part of the invention and are not required, although they are preferred for the reasons stated.

Figure 3:
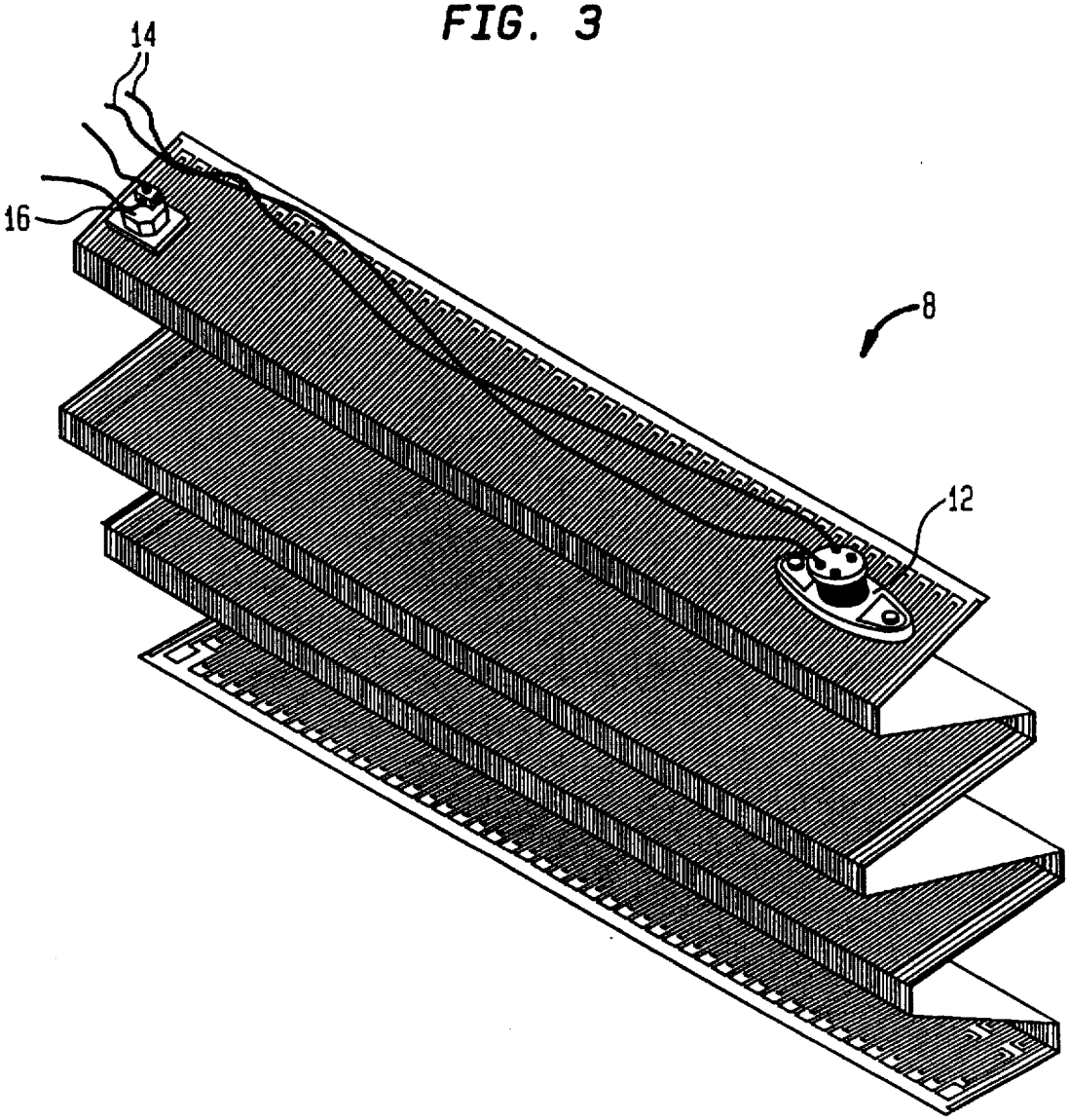
FIG. 3 shows the FIG. 2 heater element assembly bent into shape for use, with thermostats and an electrical connector mounted on it.

The preferred embodiment of the invention is made by compressing the heater element assembly 8 beyond its state as shown in FIG. 3, holding the heater element assembly 8 in its compressed state, inserting the heater element assembly 8 into a hollow open ended case 20 (FIG. 4), and releasing the heater element assembly 8. Because the heater element assembly 8 is advantageously a spring, the heater element assembly 8 expands within the case 20 and is self-supporting within it. In accordance with the preferred embodiment, no hardware is required to hold the heater element assembly 8 within the case 20.

The heater element assembly 8 should not be compressed too far before it is inserted into the case 20. If the heater element assembly 8 is overly compressed, it may become deformed and may not exert the desired force against the case 20 to hold it firmly in place. To prevent such overcompression, and to maintain even spacing of the heater element assembly 8, in accordance with a preferred embodiment spacers 22 are inserted as shown. The spacers 22 are advantageously cubes of silicone rubber, but this is not necessary. Other shapes and materials can be used and it is even possible to dispense with the spacers 22 if the compression process is sufficiently well controlled.

Figure 4:
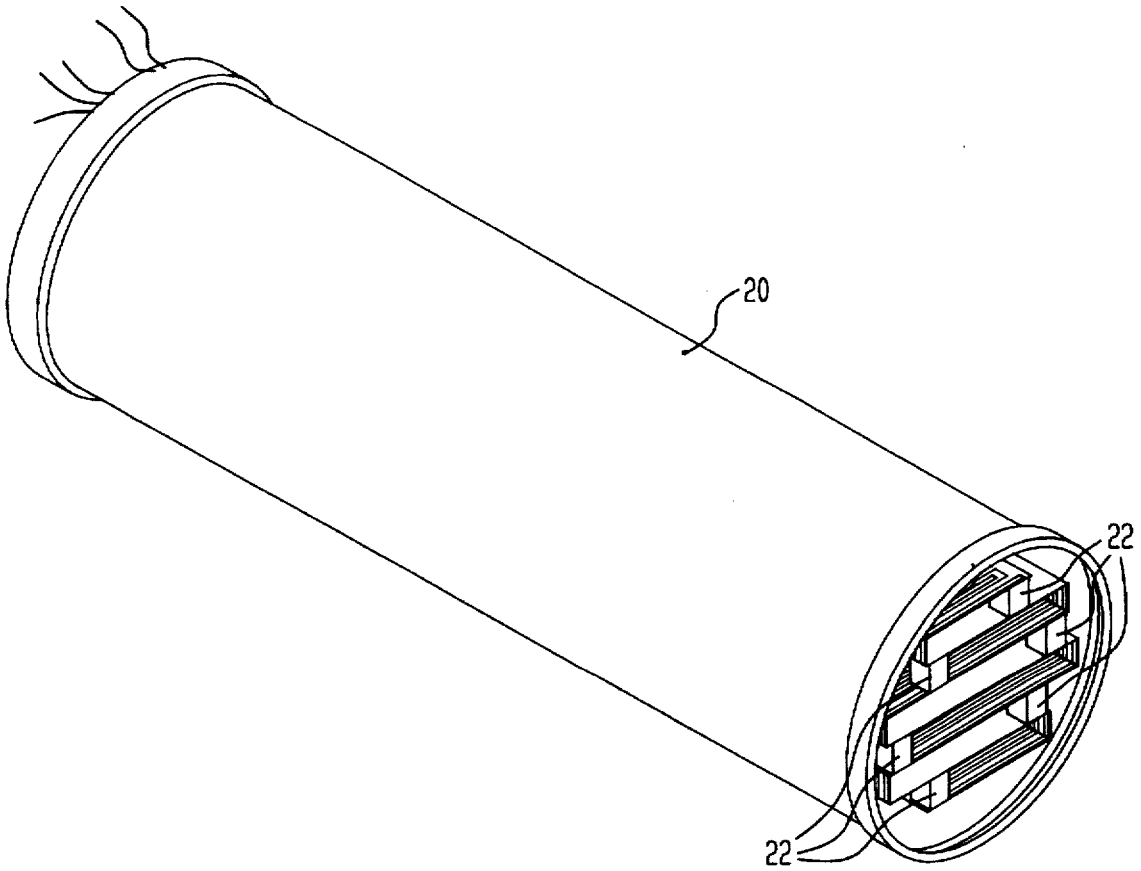
FIG. 4 shows an assembled air heater in accordance with a preferred embodiment of the invention.

If desired, the heater element assembly 8 may be adhesively secured within the case 20 instead of, or in addition to, being secured therewithin by spring pressure. This has the same appearance as is shown in FIG. 4. Suitable adhesives may be room-temperature-vulcanizing (RTV) silicone rubbers.

As shown, the case 20 is tubular. To fit properly into the case 20, the sections 10 are widest in the center of the heater element assembly 8 and narrowest at the ends of the heater element assembly 8. These shapes are not required; the case 20 may be e.g. rectangular or square in crosssection and the dimensions of the heater element assembly 8 will then be accordingly matched to the shape selected.

Figure 5:
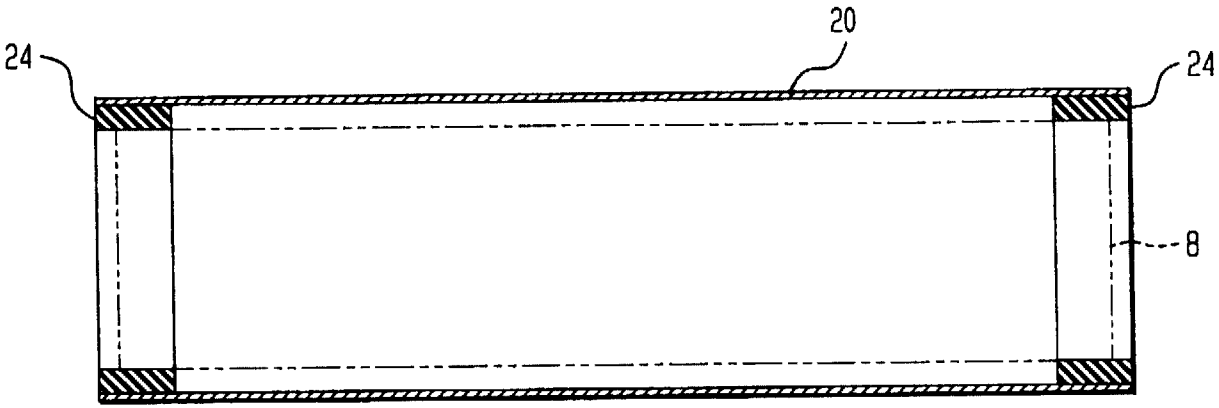
FIG. 5 shows an alternate construction of an air heater in accordance with the invention.

FIG. 5 shows an alternative construction in which the heater element assembly 8 is spaced apart from the case 20. In this embodiment, two rings 24 of e.g. silicone rubber are mounted (as by adhesive) inside the case 20 adjacent its ends. The heater element assembly 8 is held inside the rings 24 by spring pressure and/or by adhesive. This construction is used when the temperature of the case 20 must be held below some critical temperature to avoid burning service personnel.

The heat output of the preferred embodiment can be increased and decreased by respectively increasing and decreasing the length of the blank 2 and folding it into more (or fewer) generally U-shaped sections 10. This may be required to match the characteristics of the finished air heater to the ambient temperature and volume of the air to be heated.

Although a preferred embodiment has been described above, the scope of the invention is limited only by the following claims:

I claim:

1. An electro-thermal air heater, comprising:

a unitary self-supporting electrically conductive heater element, the heater element producing heat as a result of electrical current flowing therethrough, and the element being sinuous and having at least one generally U-shaped section; and a hollow open ended case surrounding the element.

2. The heater of claim 1, wherein the heater element is retained within the case by pressure exerted by the heater element against the case.

3. The heater of claim 1, wherein the heater element is etched stainless steel.

4. The heater of claim 1, wherein the heater element is coated with an insulator.

5. The heater of claim 4, wherein the insulator is a polyimide.

6. The heater of claim 1, wherein the case is tubular.

7. The heater of claim 1, wherein the heater element is adhesively secured within the case.

8. The heater of claim 1, wherein the heater element is retained within the case by adhesive and by pressure exerted by the heater element against the case.

* * * * *